US009360193B2

(12) United States Patent
Pan et al.

(10) Patent No.: US 9,360,193 B2
(45) Date of Patent: Jun. 7, 2016

(54) LIGHT-EMITTING DIODE TUBE AND LIGHT-EMITTING DIODE TUBE FASTENER THEREFOR

(71) Applicant: LUXUL TECHNOLOGY INCORPORATION, New Taipei (TW)

(72) Inventors: Cheng-Hung Pan, New Taipei (TW); Yung-Ta Hung, New Taipei (TW); Cheng-Hsien Chen, New Taipei (TW)

(73) Assignee: LUXUL TECHNOLOGY INCORPORATION, New Taipei (TW)

( * ) Notice: Subject to any disclaimer, the term of this patent is extended or adjusted under 35 U.S.C. 154(b) by 111 days.

(21) Appl. No.: 14/464,106

(22) Filed: Aug. 20, 2014

(65) Prior Publication Data

US 2015/0077983 A1 Mar. 19, 2015

(51) Int. Cl.

| | |
|---|---|
| ***F21V 21/00*** | (2006.01) |
| ***F21V 21/096*** | (2006.01) |
| ***F21K 99/00*** | (2016.01) |
| ***F21V 29/76*** | (2015.01) |
| *F21Y 101/02* | (2006.01) |

(52) U.S. Cl.

CPC ..... *F21V 21/096* (2013.01); *F21K 9/17* (2013.01); *F21V 29/763* (2015.01); *F21Y 2101/02* (2013.01)

(58) Field of Classification Search

CPC ..... F21K 9/17; F21V 21/096; F21V 29/763
USPC ..... 362/217.1–217.17, 225, 249.02, 398
See application file for complete search history.

(56) References Cited

U.S. PATENT DOCUMENTS 8,727,586 B2 * 5/2014 Wakimoto ..... F21K 9/30 362/398

* cited by examiner

*Primary Examiner* — Jason Moon Han
(74) *Attorney, Agent, or Firm* — Tracy M. Heims; Apex Juris, pllc

(57) ABSTRACT

A light-emitting diode (LED) tube has a tube and at least one LED tube fastener. Each of the at least one LED tube fastener has a body and a magnetic core. The body has at least one insertion leg formed on a bottom thereof and connected to a top wall of the tube. The magnetic core is mounted in a top portion of the body to be magnetically attached to a lamp fixture when the LED tube is mounted on the lamp fixture such that the at least one LED tube fastener holds and supports the LED tube and the LED tube is not bent due to a weight thereof.

20 Claims, 9 Drawing Sheets

LIGHT-EMITTING DIODE TUBE AND LIGHT-EMITTING DIODE TUBE FASTENER THEREFOR

BACKGROUND OF THE INVENTION

1. Field of the Invention

The present invention relates to a light-emitting diode (LED) tube and an LED tube fastener therefor, and more particularly to an LED tube fastener securely mounted on an LED tube to prevent the LED tube from bending toward the ground due to gravitational force and an LED tube having the LED tube fastener.

2. Description of the Related Art

Tube lights are one of the most extensively used lighting equipment in the modern world. To keep abreast with technological development, manufacturers produce a multitude of tube lights with different specifications. Some manufacturers start providing tube lights with prolonged lengths for increasing lighting range of the tube lights.

However, when the tube lights exceed a certain length, the middle portion of the tube lights away from two ends of the tube lights fails to stand the gravitational force of the tube lights and is thus bent toward the ground because of insufficient material strength of the tube lights.

With reference to FIG. 10, currently, a solution is to provide a tube clamp 90 mounted around a portion of a tube light 80 prone to bending as a result of the weight of the tube light 80. The tube clamp 90 is U-shaped. A curved end of the tube clamp 90 serves to carry the tube light 80, and two legs of the tube clamp 90 are fastened on a lamp fixture 92 with screws 91, such that a portion of the tube light 80 being easily bent won't be bent by the weight thereof.

The drawback of the foregoing solution resides in that lighting of the tube light 80 is partially blocked by the tube clamp 90 as the tube clamp is mounted around a part of the tube light 80, leading to a reduced lighting range.

Moreover, the portion of the lamp fixture 92 fastened by the tube clamp 90 must be machined by processes, such as drilling, screw tightening and the like, before the tube clamp 90 can be fastened on the lamp fixture 92, making the job of mounting the tube clamp inconvenient.

SUMMARY OF THE INVENTION

An objective of the present invention is to provide a light-emitting diode (LED) tube fastener and an LED tube using the LED tube fastener that block no lighting range of the LED tube and can be easily mounted.

To achieve the foregoing objective, the LED tube has a tube and at least one LED tube fastener.

Each one of the at least one LED tube fastener has a body and a magnetic core.

The body is mounted on a top of the tube and has at least one insertion leg mounted into a bottom of the body.

The magnetic core is magnetically and adjustably attached to a top of the body.

Given the foregoing LED tube, a bottom portion of the tube of the LED tube faces an area intended to be illuminated, two end portions of the tube are inserted into a lamp fixture, the at least one LED tube fastener is mounted on at least one portion of the LED tube that is prone to bending, and the magnetic core of each one of the at least one LED tube fastener faces up toward the lamp fixture. Regular lamp fixture is usually made of a magnetically attracted metal material such that each one of the at least one LED tube fastener employs at least one insertion leg on a top thereof to be connected to the LED tube and the magnetic core to magnetically connect the lamp fixture, so as to support portions of the LED tube that are prone to bending, share partial weight of the LED tube, and avoid bending of the LED tube due to the weight of the LED tube. Each one of the at least one LED tube fastener is mounted between a top portion of the LED tube and the lamp fixture without contacting the bottom portion of the tube. In other words, structurally, each one of the at least one LED tube fastener will neither block the bottom portion of the tube nor reduce the lighting range of the LED tube. As each one of the at least one LED tube fastener is magnetically attached to the lamp fixture using the magnetic core, mounting each one of the at least one LED tube fastener does not need to change the structure of the lamp fixture, thereby facilitating easy mounting of each one of the at least one LED tube fastener.

Other objectives, advantages and novel features of the invention will become more apparent from the following detailed description when taken in conjunction with the accompanying drawings.

DETAILED DESCRIPTION OF THE INVENTION

Figure 1:
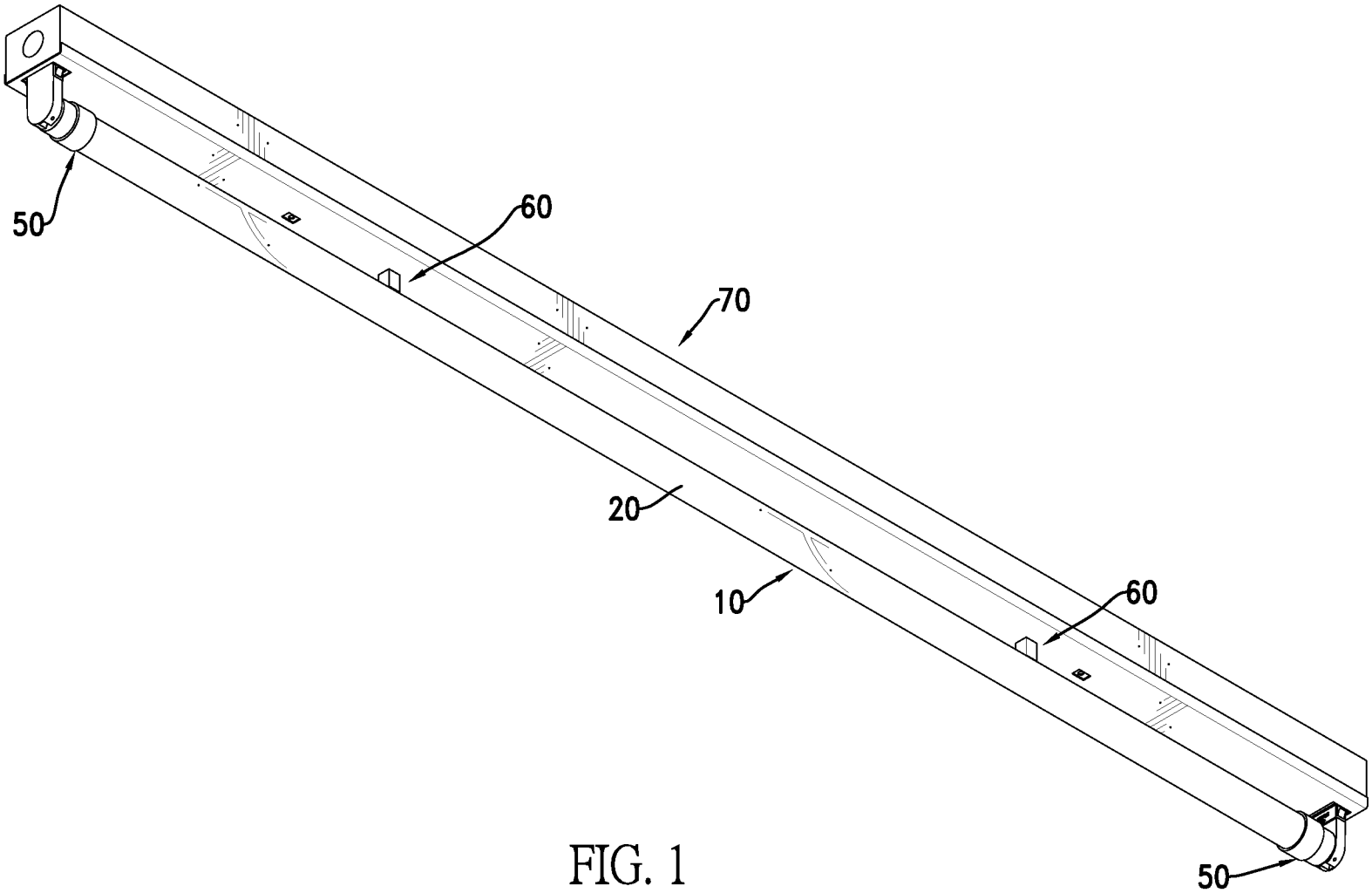
FIG. 1 is a perspective view of a first embodiment of an LED tube mounted on a lamp fixture in accordance with the present invention.

With reference to FIG. 1, a first embodiment of a light-emitting diode (LED) tube in accordance with the present invention has a tube 10 and two LED tube fasteners 60, and is mounted on a lamp fixture 70.

Figure 2:
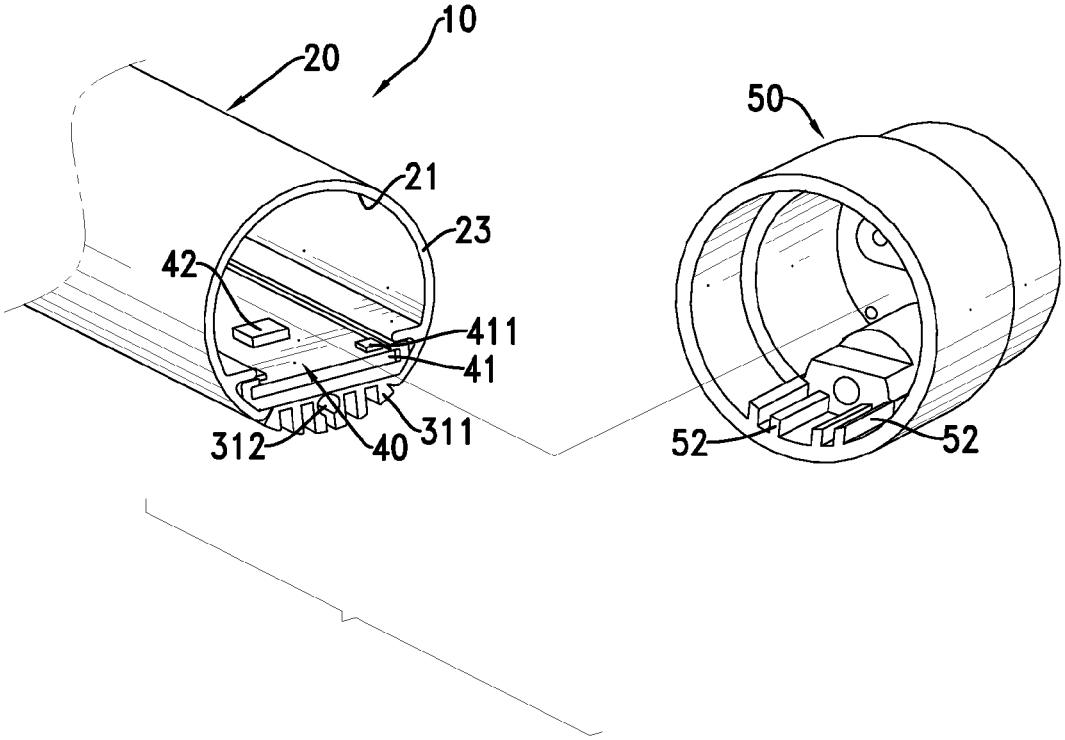
FIG. 2 is a partially enlarged exploded perspective view of the LED tube in FIG. 1.
Figure 3:
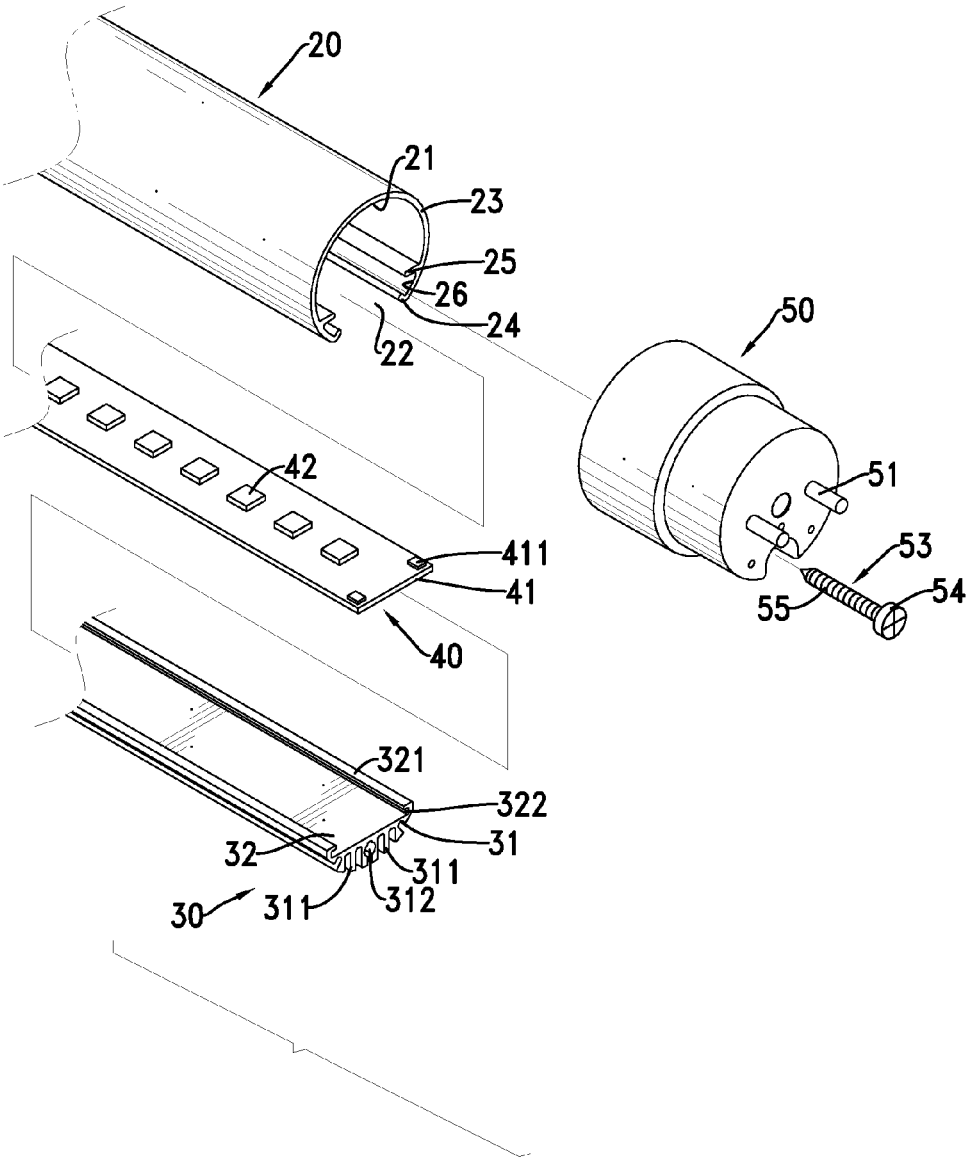
FIG. 3 is another partially enlarged exploded perspective view of the LED tube in FIG. 1.
Figure 4:
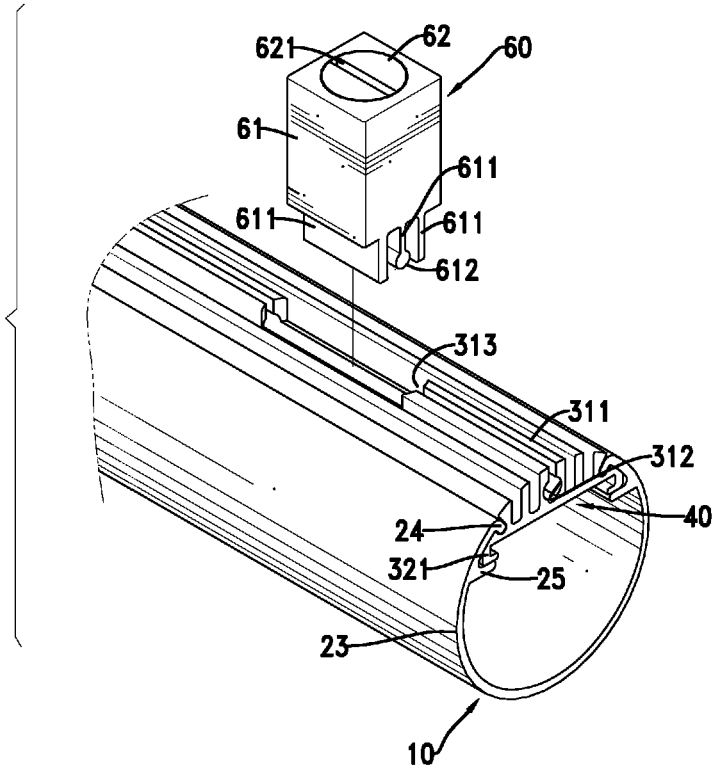
FIG. 4 is a perspective view of an LED tube fastener in accordance with the present invention mounted to an LED tube in FIG. 1.
Figure 5:
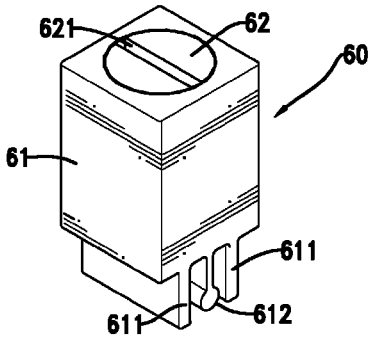
FIG. 5 is a perspective view of the LED tube fastener in FIG. 4.
Figure 6:
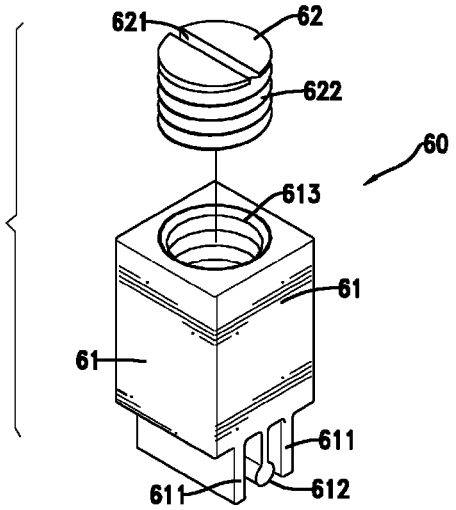
FIG. 6 is an exploded perspective view of the LED tube fastener in FIG. 5.
Figure 7:
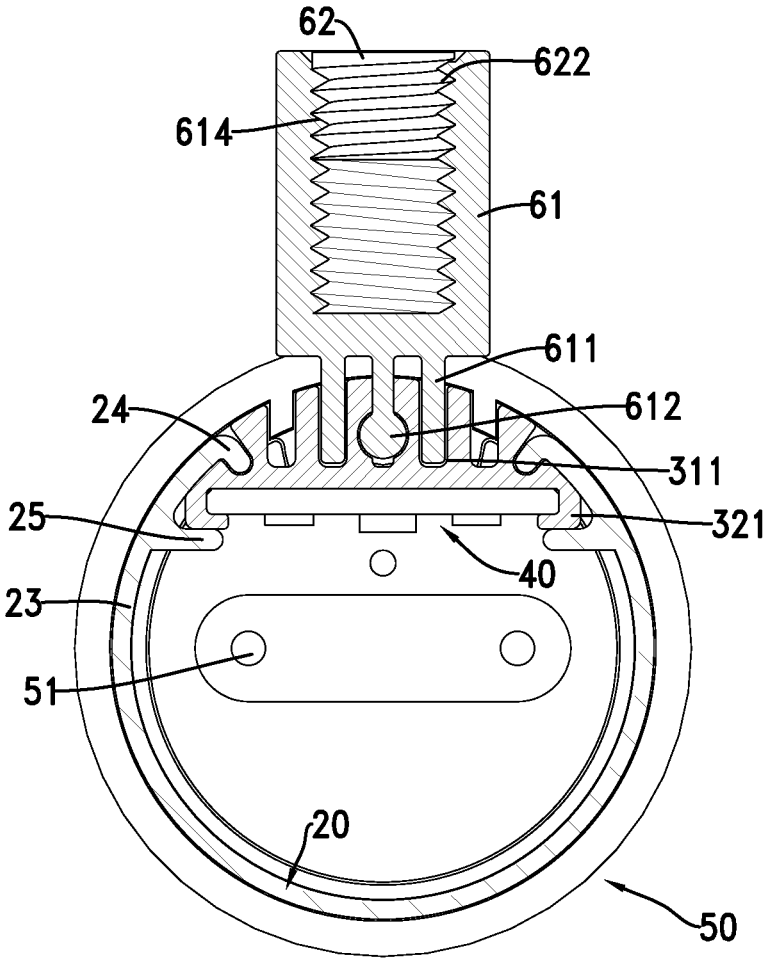
FIG. 7 is an operational enlarged front view in partial section of the LED tube in FIG. 1.
Figure 8:
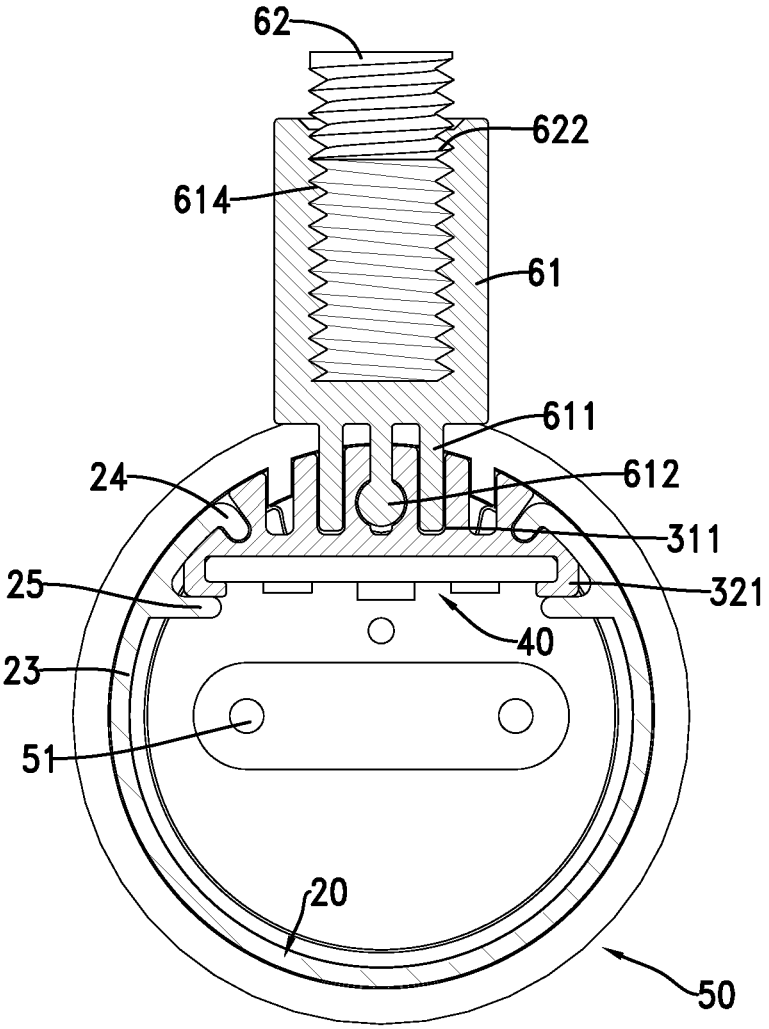
FIG. 8 is another operational enlarged front view in partial section of the LED tube in FIG. 1.

With reference to FIGS. 2 to 4, the tube 10 has a tube shell 20 and a heat sink 30. The tube shell 20 is tubular and transparent, and has two end openings 21, an elongated breach 22 and a covering wall 23. The elongated breach 22 is formed partially through a peripheral wall of the tube shell 20 across an axial length of the tube shell 20, and faces up. The remaining part of the peripheral wall of the tube shell 20 forms the covering wall 23. The covering wall 23 has two axial edges delimiting the elongated breach 22.

The heat sink 30 is elongated, is slidably mounted in the elongated breach 22 of the tube shell 20, and has a top surface 31 and a bottom surface 32. The top surface 31 aligns with the elongated breach 22 of the tube shell 20 and has multiple heat-dissipating fins 311, a sliding channel 312 and an indentation 313. The heat-dissipating fins 311 are formed on and protrude upwards from the top surface 31 and are spaced apart from each other by a gap. The sliding channel 312 is longitudinally formed in two proximal walls of two adjacent ones of the head-dissipating fins 311 across an axial length of the heat sink 30. The indentation 313 is longitudinally formed in top edges of the two adjacent heat-dissipating fins 311 that have the sliding channel 312.

The tube shell 20 further has two first holding ribs 24, two second holding ribs 25 and two first sliding channels 26. The two first holding ribs 24 are respectively formed on and protrude inwards from two axial edges of the covering wall 23. The two second holding ribs 25 are formed on and protrude horizontally and inwards from two opposites positions on an inner periphery of the covering wall 23 and are located under the first holding ribs 24. Each first sliding channel 26 is formed between the first holding rib 24 and the second holding rib 25 adjacent to each other. The heat sink 30 has two sliding ridges 321 respectively formed on and protruding downwards from a bottom of the heat sink 30 to correspond to and to be slidably mounted into the respective first sliding channels 26 of the tube shell 20. Two sliding slots 322 are oppositely formed in two inner sides of the two sliding ridges 321.

The tube 10 further has an LED light board 40 and two lamp caps 50. The LED light board 40 is mounted on the bottom of the heat sink 30 to dissipate heat generated from the LED light board 40 to the heat-dissipating fins 311 of the heat sink 30. The LED light board 40 has two electrical connection parts 411 and multiple LED elements 42. The two electrical connection parts 411 are formed on the LED light board 40 and are adjacent to one end 41 of the LED light board 40 corresponding to one of the end openings 21 of the tube shell 20. In the present embodiment, the LED light board 40 is slidably mounted in the heat sink 30 through the two sliding slots 322.

The two lamp caps 50 are respectively mounted around the two end openings 21 of the tube shell 20. Each lamp cap 50 has an open side, a closed side, two electrode terminals 51, multiple fin-fixing portions 52 and a screw 53. The two electrode terminals 51 are mounted through the closed end of the lamp cap 50 in a direction from the closed end to the open end, and are electrically connected to the respective electrical connection parts 411. Each fin-fixing portion 52 is formed on an inner wall of the lamp cap 50 to correspond to the gap between two adjacent ones of the heat-dissipating fins 311 such that the fin-fixing portions 52 respectively engage the heat-dissipating fins 311 to further fix the lamp cap 50 when the lamp cap 50 is mounted around a corresponding end opening 21 of the tube shell 20. The screw 53 has a head 54 and a stud 55. The head 54 is formed on one end of the stud 55. The other end of the stud 55 is mounted into the lamp cap 50 through the sliding channel 312 of the heat sink 30 until the head 54 abuts against an outer end face of the closed end of the lamp cap 50, thereby fastening the lamp cap 50 to one end of the tube 10.

With reference to FIGS. 4 to 8, each LED tube fastener 60 has a body 61 and a magnetic core 62. The body 61 has three insertion legs 611 and a positioning bore 613. The insertion legs 611 are plate-shaped and are spaced apart from each other by gaps. The insertion legs 611 and the heat-dissipating fins 311 have an identical thickness and an identical gap width. Each insertion leg 611 is inserted into corresponding two adjacent ones of the heat-dissipating fins 311. The central insertion leg 611 is inserted into the two adjacent heat-dissipating fins 311 through which the sliding channel 312 is longitudinally formed, and has an expanded end portion 612 longitudinally formed on a free end of the insertion leg 611 and corresponding to the sliding channel 312 for the LED tube fasteners 60 to be slidably moved relative to the heat-dissipating fins 311. The positioning bore 613 is formed in a top side of the body 61 opposite to the insertion legs 611, and has an inner threaded portion 614 formed on an inner wall of the positioning bore 613. The magnetic core 62 is cylindrical and is mounted inside the positioning bore 613 and has a slotted portion 621 and an outer threaded portion 622. The slotted portion 621 is formed in a top surface of the magnetic core 62 facing the positioning bore 613. The outer threaded portion 622 is formed on a cylindrical periphery of the magnetic core 62 to correspond to the inner threaded portion 614 of the positioning bore 613 for the magnetic core 62 to be screwed into the positioning bore 613. The slotted portion 621 may include one single slot across the slotted portion or may be cross recessed such that a tool, such as a slotted screwdriver or a cross screwdriver, can be inserted in the slotted portion 621 and then turned to adjust a position of the magnetic core 62 inside the positioning bore 613 such that the magnetic core 62 can move upwards to extend beyond the positioning bore 613 or move downwards to be received in the positioning bore 613 and a distance between the magnetic core 62 and the lamp fixture 70 is adjustable. The insertion legs 611 can be mounted into the heat-dissipating fins 311 through the indentation 313 of the heat sink 30. The expanded end portion 612 is slidably mounted inside the sliding channel 312 for the LED tube fasteners 60 to be slidably positioned on the heat-dissipating fins 311.

When the LED tube is in use, the magnetic cores 62 are adjustably and magnetically attached to appropriate locations for adjusting heights of the LED tube fasteners 60 in a vertical direction to match a distance between the heat sink 30 and the lamp fixture 70. The LED tube fasteners 60 are slidably positioned at locations of the LED tube that are structurally prone to bending, so as to support the LED tube and prevent the LED tube from being bent by its weight.

Figure 9:
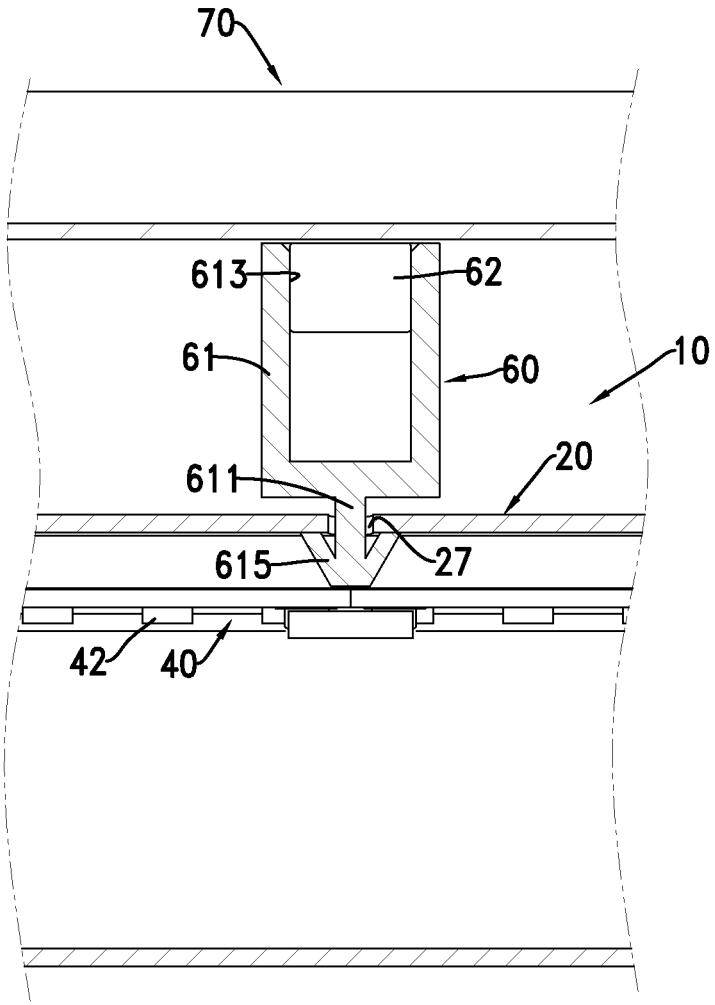
FIG. 9 is an operational partial side view in partial section of a second embodiment of an LED tube mounted on a lamp fixture in accordance with the present invention.
Figure 10:
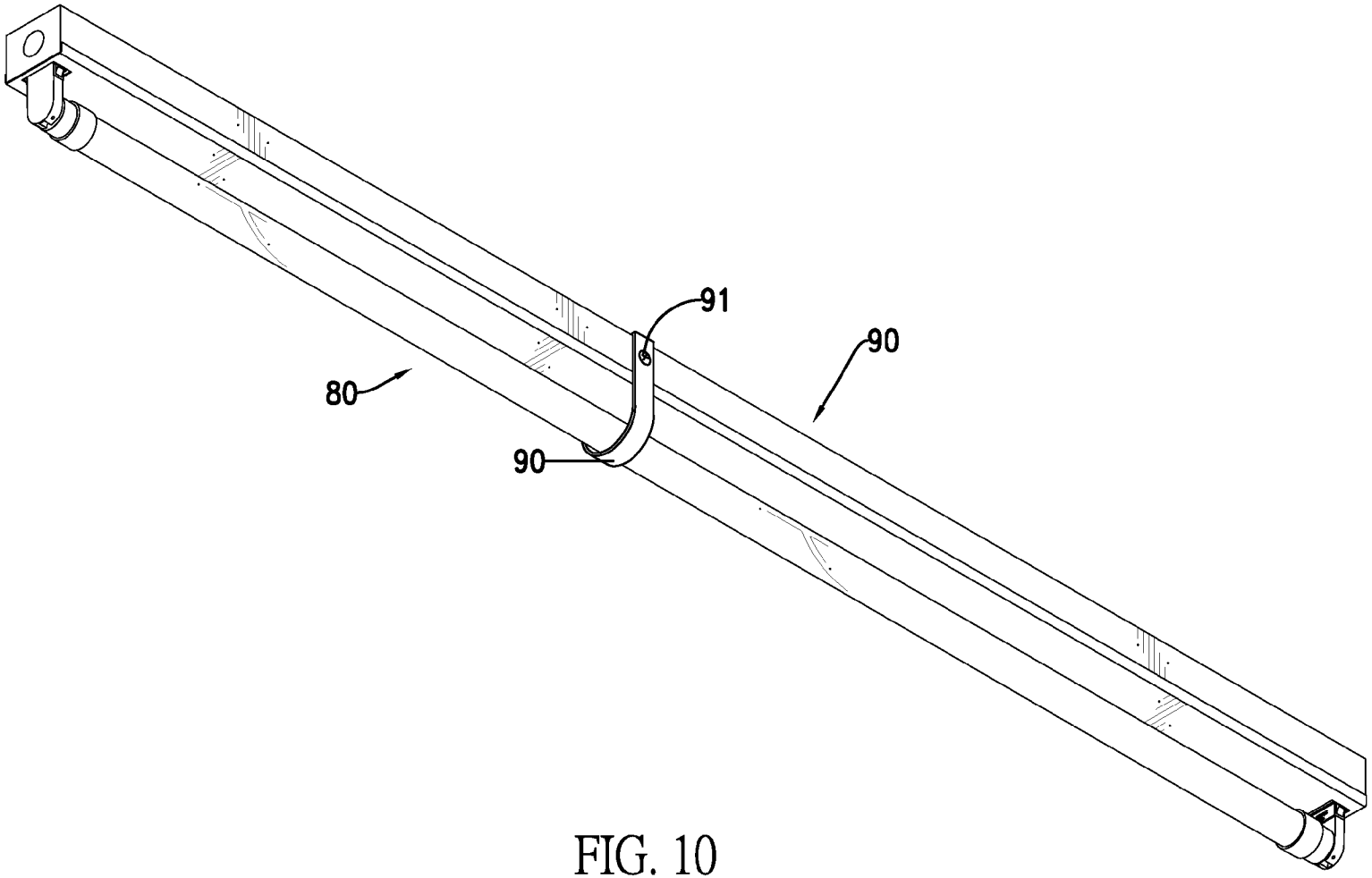
FIG. 10 PRIOR ART
FIG. 10 is a perspective view of a conventional light tube fastened by a tube clamp.

With reference to FIG. 9, a second embodiment of an LED tube in accordance with the present invention is shown and differs from the first embodiment in that the tube shell 20 of the present embodiment does not have the elongated breach 22, the tube does not have the heat sink 30, one side of the tube shell 20 facing the lamp fixture 70 has a connection hole 27 formed through the side, the positioning bores 613 of the LED tube fasteners 60 and the magnetic cores 62 do not have the respective inner threaded portion 614 and the outer threaded portion 622, each magnetic core 62 is bonded inside a corresponding positioning bore 613 with adhesive, and the central insertion leg 611 of the LED tube fasteners 60 does not have the expanded end portions 612 but instead has a resilient fastener 615 taking a form of an arrow head, formed on the free end of the insertion leg 611 with an arrow head tip facing down, and mounted on a backlight surface of the tube 10 when the central insertion leg 611 is mounted through the connection hole 27.

From the foregoing description, all embodiments of the LED tube fasteners 60 only employ the insertion legs 611 to connect with the backlight surface of the LED tube in accordance with the present invention without blocking the tube shell 20. Hence, the LED tube fasteners 60 will not affect the lighting range of the LED tube in accordance with the present invention. Furthermore, the top sides of the LED tube fasteners 60 facing the lamp fixture 70 can be attached to the lamp fixture 70 by magnetic force of the magnetic bores 62. There is no need to alter the design of the lamp fixture 70 for matching the LED tube fasteners 60. Accordingly, the LED tube fasteners 60 are more conveniently mountable than conventional tube clamps.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A light-emitting diode (LED) tube fastener, comprising:

a body having at least one insertion leg formed on a bottom of the body for mounting on an LED tube; and a magnetic core mounted in a top of the body.

2. The LED tube fastener as claimed in claim 1, wherein the body has a positioning bore formed in the top of the body, and the magnetic core is mounted inside the positioning bore.

3. The LED tube fastener as claimed in claim 2, wherein the positioning bore has an inner threaded portion formed on an inner wall of the positioning bore; and the magnetic core has an outer threaded portion formed on an outer periphery of the magnetic core and corresponding to the inner threaded portion for the magnetic core to engage the positioning bore.

4. The LED tube fastener as claimed in claim 3, wherein the magnetic core has a slotted portion formed in a top of the magnetic core.

5. The LED tube fastener as claimed in claim 4, wherein one of the at least one insertion leg has an expanded end portion longitudinally formed on a free end of the insertion leg.

6. The LED tube fastener as claimed in claim 1, wherein one of the at least one insertion leg has a resilient fastener taking a form of an arrow head and formed on a free end of the insertion leg with an arrow head tip facing down.

7. The LED tube fastener as claimed in claim 2, wherein the magnetic core is bonded inside the positioning bore with adhesive.

8. The LED tube fastener as claimed in claim 4, wherein the slotted portion of the magnetic core has a single slot across the slotted portion.

9. The LED tube fastener as claimed in claim 4, wherein the slotted portion is cross recessed.

10. A light-emitting diode (LED) tube, comprising:

a tube; and at least one light-emitting diode (LED) tube fastener, each one of the at least one LED tube fastener having:

a body mounted on a top of the tube and having at least one insertion leg mounted into a bottom of the body; and a magnetic core magnetically and adjustably attached to a top of the body.

11. The LED tube as claimed in claim 10, wherein the tube has:

a tube shell being tubular and transparent, and having two end openings;

an LED light board mounted inside the tube and having two electrical connection parts formed on the LED light board and adjacent to one end of the LED light board corresponding to one of the end openings of the tube shell; and two lamp caps respectively mounted around the two end openings of the tube shell, each lamp cap having:

an open side;

a closed side; and two electrode terminals mounted through the closed end of the lamp cap in a direction from the closed end to the open end, and being electrically connected to the respective electrical connection parts.

12. The LED tube as claimed in claim 11, wherein the body of each one of the at least one LED tube fastener has a positioning bore formed in a top side of the body opposite to the at least one insertion leg, and the magnetic core of the LED tube fastener is mounted inside the positioning bore.

13. The LED tube as claimed in claim 12, wherein the positioning bore of each one of the at least one LED tube fastener has an inner threaded portion formed on an inner wall of the positioning bore; and the magnetic core of the LED tube fastener has an outer threaded portion formed on an outer periphery of the magnetic core to correspond to the inner threaded portion of the positioning bore for the magnetic core to be screwed into the positioning bore.

14. The LED tube as claimed in claim 13, wherein the magnetic core of each one of the at least one LED tube fastener further has a slotted portion formed in a top surface of the magnetic core facing a corresponding positioning bore.

15. The LED tube as claimed in claim 11, wherein the tube shell has:

an elongated breach formed partially through a peripheral wall of the tube shell across an axial length of the tube shell and facing up;

a covering wall having two axial edges delimiting the elongated breach; and the tube further has a heat sink, wherein the heat sink is elongated, is slidably mounted in the elongated breach of the tube shell, and has a top surface and a bottom surface, the top surface aligns with the elongated breach of the tube shell and has multiple heat-dissipating fins formed on and protruding upwards from the top surface; and each one of the at least one insertion leg is inserted into two adjacent ones of the heat-dissipating fins.

16. The LED tube as claimed in claim 15, wherein the heat sink has a sliding channel longitudinally formed in two proximal walls of two adjacent ones of the head-dissipating fins across an axial length of the heat sink; and one of the at least one insertion leg has an expanded end portion longitudinally formed on a free end of the insertion leg and corresponding to the sliding channel for each one of the at least one LED tube fastener to be slidably moved relative to the heat-dissipating fins of the heat sink.

17. The LED tube as claimed in claim 15, wherein the body of the LED tube fastener has multiple insertion legs, the insertion legs and the heat-dissipating fins have an identical thickness and an identical gap width for each insertion leg to be inserted into corresponding two adjacent ones of the heat-dissipating fins.

18. The LED tube as claimed in claim 11, wherein the magnetic core is bonded inside a corresponding positioning bore with adhesive.

19. The LED tube as claimed in claim 14, wherein the slotted portion of each one of the at least one magnetic bore includes one single slot across the slotted portion.

20. The LED tube as claimed in claim 14, wherein the slotted portion of each one of the at least one magnetic bore is cross recessed.

* * * * *